United States Patent [19]

Waris et al.

[11] 3,933,966

[45] Jan. 20, 1976

[54] METHOD AND DEVICE FOR SPRAYING FLUID INTO A HEADBOX

[75] Inventors: Veikko Kaarlo Tapio Waris, Kotka; Frey Viking Sundman, Karhula, both of Finland

[73] Assignee: A. Alhstrom Osakeyhtio, Finland

[22] Filed: May 13, 1974

[21] Appl. No.: 469,058

Related U.S. Application Data

[63] Continuation-in-part of Ser. No. 369,853, June 14, 1973, abandoned.

[52] U.S. Cl. ..... 162/183; 162/190; 162/212; 162/336; 162/380

[51] Int. Cl.[2] ..... D21F 1/08; D21F 1/66

[58] Field of Search ..... 162/208, 212, 216, 183, 162/336, 190, 264, 297, 308, 344, 380

[56] References Cited

UNITED STATES PATENTS 3,092,538 6/1963 Parker ..... 162/216

3,846,229 11/1974 Kallmes ..... 162/216

FOREIGN PATENTS OR APPLICATIONS 419,369 11/1934 United Kingdom ..... 162/208

*Primary Examiner*—S. Leon Bashore
*Assistant Examiner*—Richard V. Fisher
*Attorney, Agent, or Firm*—Bucknam and Archer

[57] ABSTRACT

In a device for feeding fiber suspension to the web-forming part of a paper machine the tendency of the fibers in the suspension to flocculate and form fiber clusters, before being fed onto the web-forming wire, is eliminated by spraying jets of water or steam or both into the head box which is supplied with a fiber suspension of a consistency greater than the desired. The jets cause strong turbulences in the head box and thereby effectively disperse the fiber clusters.

15 Claims, 9 Drawing Figures

METHOD AND DEVICE FOR SPRAYING FLUID INTO A HEADBOX

This application is a continuation-in-part of U.S. Ser. No. 369,853, filed June 14, 1973, now abandoned.

This invention relates generally to the feeding of fiber suspension to the web-forming part of a paper machine and particularly to the feeding wherein the fiber suspension is distributed into a flow which extends over the entire width of the web-forming part and is stirred, whereafter the suspension is allowed to settle before being fed into the web-forming part.

It is known that the fibers in a suspension tend to flocculate and form fiber clusters. To prevent this, paper machines have in the past been provided with rotating perforated rollers through which the fiber suspension flows in order to disperse the fiber clusters. The dispersing effect of the perforated rollers on fiber clusters is, however, limited for the following reasons: fibers tend to accumulate in the perforated rollers which create a long scale turbulence due to the dimensions of the perforations, and the size of the gaps between the perforated rollers and the head box walls is not sufficiently small to prevent suspension from escaping as a laminar flow containing fiber clusters. This being the case, it has not been possible to maintain the desired high consistency in the head box because the clustering tendency of the fibers is greatly intensified when the fiber content, i.e. consistency of the suspension, increases and therefore it has been difficult to manufacture good paper.

In accordance with the present invention a method is provided for feeding fiber suspension to the web-forming part of a paper machine or the like, a method by which an evenly distributed fiber suspension, which does not contain clusters but has a relatively high concentration, can be fed to the web-forming part of a paper machine or the like.

Further in accordance with this invention a structurally simple head box is provided for the application of the method according to the invention.

According to the invention, a fiber suspension at a greater than the desired consistency is fed into the head box, where it is diluted into the final desired consistency by spraying a fluid, water and/or steam into it. The density of the suspension exceeds 1% and is for instance, 1.5%. The desired density for paper making purposes is lower than 1%. The water and steam jets cause strong turbulences in the head box, thereby effectively dispersing all fiber clusters. In the method according to the invention the initial consistency of the fiber suspension is so high that fiber clusters are likely to be formed, but the dispersion of the fibers in the head box is so effective due to the steam or water sprays that all fiber clusters are dispersed. For this reason, the distribution means feeding the fiber suspension into the head box can be very simple and small, because the unusually thick suspension also contains less water than usual and therefore the pumping rate and the sizes of the pumps and other auxiliary devices can be respectively diminished.

In order to obtain an even basic weight profile across the paper web, the fiber suspension must also be evenly distributed over the width of the machine. In the method according to the invention the amount of dilution liquid is great in proportion to the amount of fiber suspension fed into the distribution system and the mixing is so effective that any possible local variations in the amount of fiber are leveled. Because the mixing is so effective, additives such as chemicals and fillers can be fed into the head box together with the dilution water. A turbulence must be created which has a sufficient vortex size and intensity in the head box to disperse the fiber clusters but is so small in the outflow gap of the lip part of the head box that the suspension is fed calmly on the wire. It has been noted that the perforated roller generally used in head boxes does not faultlessly meet either requirement, for fibers tend to accumulate in the rollers and the perforated roller creates a large scale turbulence depending on the dimensions of the perforations.

Figure 5:
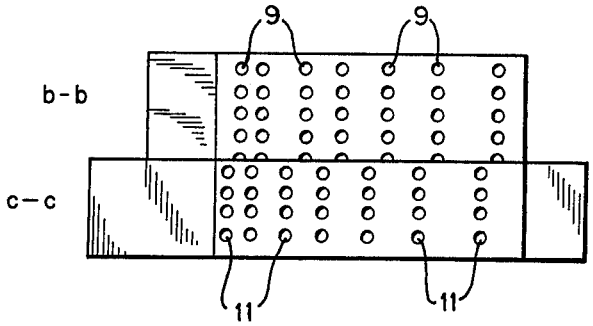
Figure 7:
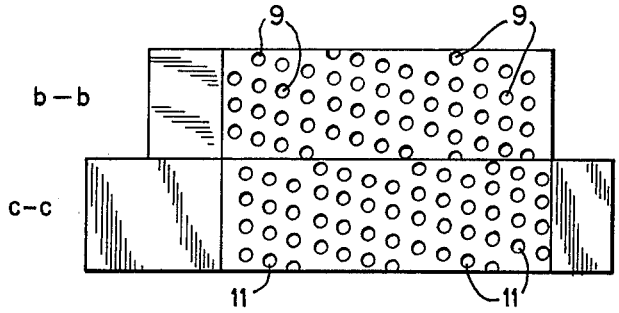

FIGS. 5 and 7, illustrate the embodiment in which the perforations in the upper plate, designated by numeral 9 are not in alignment with the perforations in the lower plate, designated by numeral 11.

Figure 6:
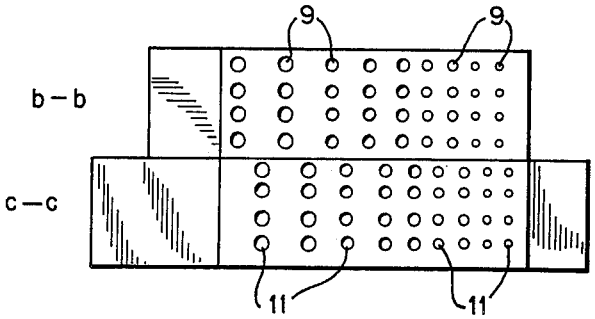

FIG. 6 illustrates the embodiment in which the size of the perforations and the distance between the perforations decreases towards the head box lip part.

Figure 8:
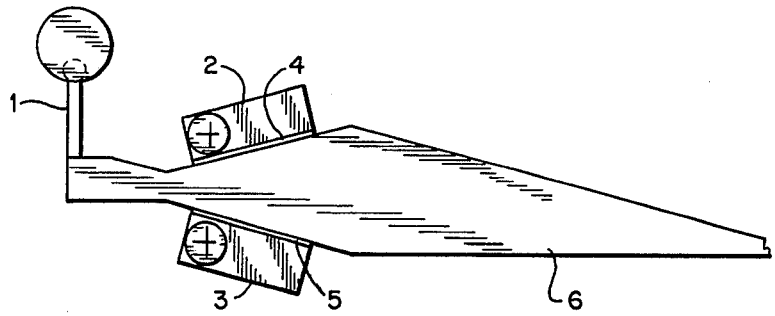

FIG. 8 illustrates the embodiment in which the two perforated plates form a flow channel which diverges towards the lip part.

Figure 9:
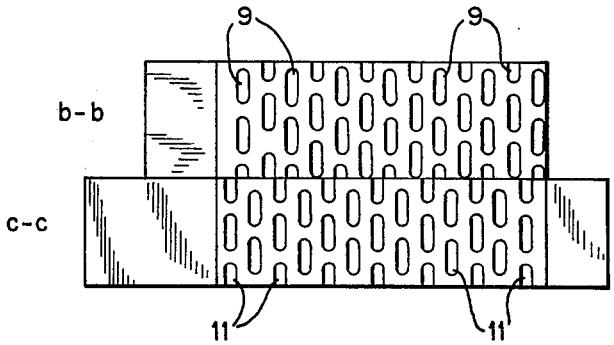

FIG. 9 illustrates the embodiment in which the perforations are oblong transversely to the direction of the fiber suspension.

Figure 2:
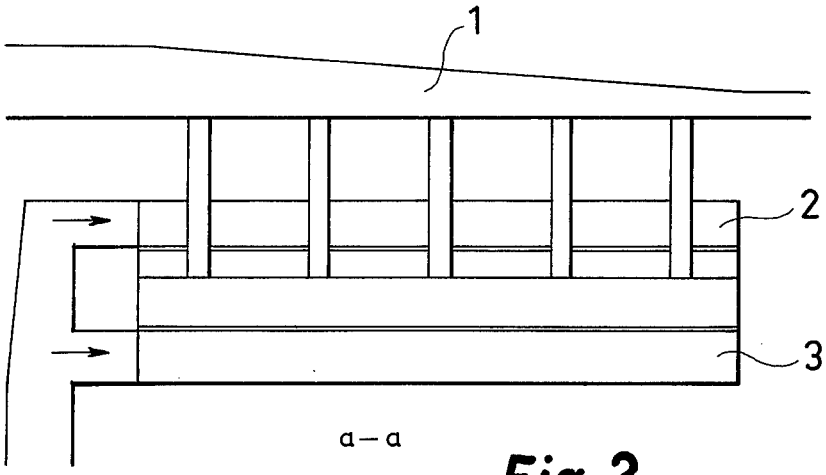
FIG. 2 shows a front view of the same device.
Figure 1:
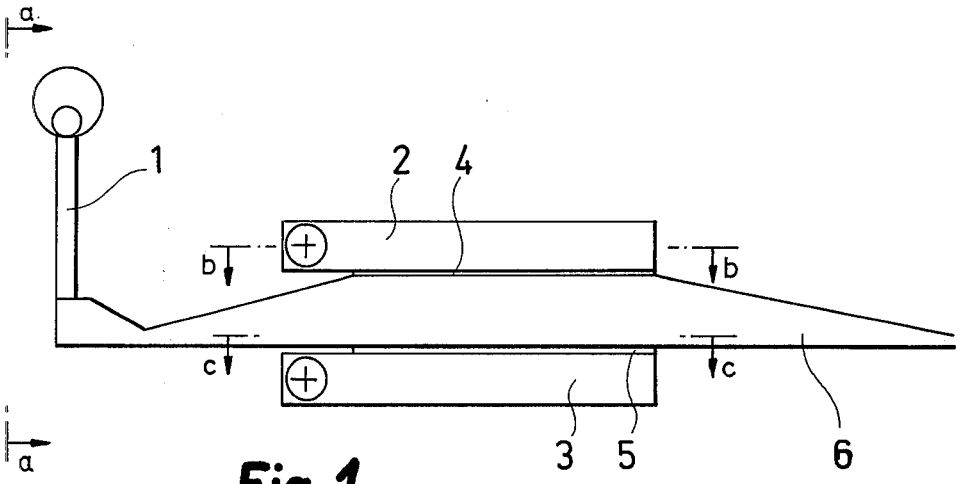
FIG. 1 shows a schematic side view of a device according to the invention, in which the supply box for the dilution fluid is located parallel to the direction of flow of the fiber suspension.
Figure 3:
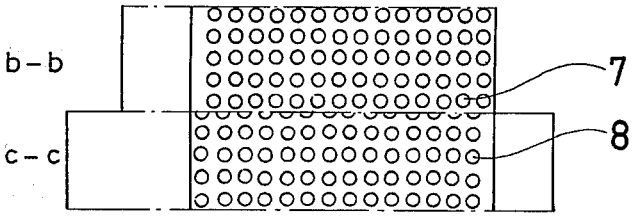
FIG. 3 shows sections along lines *b—b* and *c—c* in FIG. 1.

In FIGS. 1 and 2, number 1 refers to the fiber suspension feeder and 2, 3 to a dilution water supply box. The wall between the dilution water supply box 2, 3 and the head box consists of a perforated plate 4, 5, through which the dilution water flows. Number 6 refers to the head box lip part. The holes in the perforated plates are preferably out of alignment in relation to each other, as shown in FIG. 3. Perforation 7 is that of upper plate 4 and perforation 8 that of lower plate 5.

The pressure prevailing in the water box is higher than in the head box. The water which flows through the perforations at a high rate forms dense spray curtains which create a turbulence in the fiber suspension flowing through the head box. The intensity of the turbulence can be regulated by changing the pressure of the dilution water.

Figure 4:
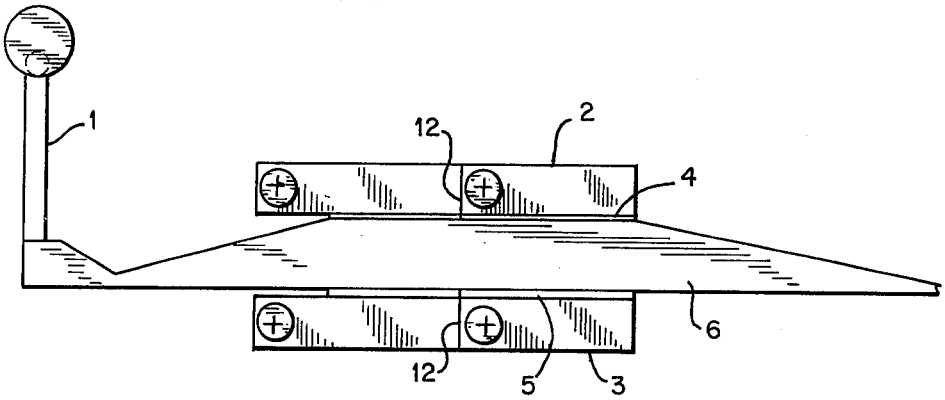
FIG. 4 illustrates the embodiment in which the supply box for the dilution fluid is divided into more than one successive partition. Numeral 12 designates the partition or baffle arranged transversely to the flow of the suspension.

FIG. 4 illustrates the embodiment in which a plurality of supply boxes for the dilution fluids and a plurality of head boxes may be used. FIG. 4 illustrates the use of two head boxes and two supply boxes with one partition designated by numeral 12. Water box 2, 3 may comprise one or more partitions or baffles 12 and in the latter case each partition is provided with its own inlet pipe, in which case the inlet pressures of the partitions can also be different, preferably so that the pressure of the partitions decreases towards the lip part. Perforations 7, 8 of the perforated plate can be evenly distributed on the surface of the plate 4, 5 in FIG. 3 or distributed as perforations 9, 11 in FIG. 5 so that the distances between them are different points, for example, so that the distances between the perforations decrease towards lip part 6. The size of perforations 7, 8 can also be varied as perforations 9, 11 in FIG. 6, for example so that the diameter changes in the longitudinal direction of the head box from 10 mm to 0.5 mm, in which case the smallest perforations are situated closest to lip part 6. The direction of perforations 7, 8 in FIG. 3 in opposite perforated plates 4, 5 can be the same or they can form an angle with each other as perforations 9, 11 in FIG. 7. The perforations can be cylindrical or conical. They must be relatively close to each other to obtain a homogeneous mixing. Distance L between the centers of the perforations is usually less than 5 *d*, *d* being the diameter of a perforation.

Example: H = 80 mm
L = 12 mm
d = 4 mm
l = 20 mm

Perforated plates 4, 5 can be parallel or form a flow channel which diverges towards the lip part. FIG. 8 illustrates the embodiment in which the two perforated plates 4 and 5 form a flow channel which diverges towards the lip part 6 of the head box. The shape of the perforated plates can naturally be other than plane-like. One perforated plate may be absent. The perforations can also be replaced with oblong gaps such as perforations 9, 11 in FIG. 9 which are transversal in relation to the direction of the flow.

Steam can be fed instead of water or in addition to water through openings 7, 8, in which case the fiber suspension is heated and water removal on the wire is improved. The fed water can be re-circulated water or pure water.

For example, stock with a fiber concentration of 2.5 % can be fed into the head box where it is diluted to 0.5 %.

In one embodiment, the perforated roller situated immediately before the lip part in a conventional head box is replaced with a spray zone where the holes are small, in which case the main purpose is to create a turbulence, and the dilution effect is without significance.

The fibers fed by this method and with the device according to the invention are preferably cellulose fibers, but the invention may be adapted also to artificial fibers, such as silicate fibers.

Paper having the weight of 50 g/m² was manufactured at the rate of 400 m/min. by the method according to the invention, whereby stock having the density of 2.5 % fiber concentration was fed at the rate of 800 l/min. . m into the head box and water was fed simultaneously into it at the rate of 3200 l/min. . m so that the outflow of water from the perforated plates was 4.8 m/s. At this time the fiber concentration in the lip part of the head box decreased to 0.5 % and the flow rate increased to 4000 l/min. Thus, the obtained flow rate of the stock was 26 m/min. before dilution with water and 130 m/min. after dilution with water.

What is claimed is:

1. A method of feeding fiber suspension to the web-forming part of a paper machine while avoiding flocculation and avoiding the use of rollers, which comprises (1) feeding a thick suspension of fibers to a head box, (2) spraying a fluid which is at least one of water and steam into said thick suspension in order to dilute the same to the desired thickness before feeding it to the web-forming part and create turbulence therein to mix the suspension and thereby disperse fiber clusters, the supply box for spraying said fluid being mounted immediately adjacent to the head box wall and being separated from the inner part of the center portion of the head box by a perforated plate, the turbulence being of such intensity in the head box to disperse the fiber clusters, (3) then allowing the suspension to settle, under a turbulence of small intensity, in the lip part of the head box whereby said suspension is fed essentially free from the large scale turbulence to the web-forming part, said lip part being of sufficient length to reduce the turbulence of the suspension and (4) distributing the fiber suspension into a flow extending over the entire width of the web-forming part.

2. A method as recited in claim 1, wherein the diluting of the suspension is performed with water containing additives such as chemicals and fillers.

3. A method as recited in claim 1, wherein the diluting is performed with recirculated water separated at the web-forming stage.

4. A method as recited in claim 1, wherein the dilution is performed with steam.

5. A method as recited in claim 1, wherein the intensity of spraying of the dilution fluid is regulated to decrease in the direction of the suspension flow.

6. An apparatus for feeding fiber suspension to the web-forming part of a paper machine of the type having a head box and a fiber suspension feeder supplying the head box with said suspension, comprising means mounted to at least one of the upper and lower wall of the head box to extend between the suspension feeder and the lip part of the head box for spraying a dilution fluid into the fiber suspension to dilute and agitate the same and wherein the feeding device for the dilution fluid is a supply box mounted immediately adjacent to the head box wall and separated from the inner part of the head box by a perforated plate, said head box having a center portion and a converging lip portion, said lip portion being of sufficient length to reduce the turbulence of the suspension to a small intensity, said supply box being connected to said center portion.

7. An apparatus as recited in claim 6, wherein the supply box for the dilution medium is divided into more than one successive partitions, each of which is provided with its own inlet pipe and controls for individual regulation of the pressures in the partitions.

8. An apparatus as recited in claim 6, wherein the distances between the holes in the perforated plate decrease towards the head box lip part.

9. An apparatus as recited in claim 6, wherein the size of the holes in the perforated plate decreases toward the head box lip part.

10. An apparatus as recited in claim 6, wherein the holes in the perforated plate of opposite walls are not in alignment in relation to each other.

11. An apparatus as recited in claim 6, wherein the distance between the center points of adjacent holes in the perforated plate is shorter than five times a hole diameter.

12. An apparatus as recited in claim 6, wherein the two perforated plates form a flow channel diverging toward the lip part.

13. An apparatus as recited in claim 6, wherein the holes in the perforated plate are oblong gaps transversal to the fiber suspension flow direction.

14. An apparatus as recited in claim 6, wherein said center portion of the head box has parallel walls.

15. An apparatus as recited in claim 6, wherein said center portion of the head box has diverging walls.

* * * * *